US007026945B2

(12) United States Patent
Hill

(10) Patent No.: US 7,026,945 B2
(45) Date of Patent: Apr. 11, 2006

(54) ALARM DEVICE INTERFACE SYSTEM

(75) Inventor: Bobby D. Hill, Arlington, TX (US)

(73) Assignee: Bobby Dwyane Hill, Mansfield, TX (US)

( * ) Notice: Subject to any disclaimer, the term of this patent is extended or adjusted under 35 U.S.C. 154(b) by 21 days.

(21) Appl. No.: 10/649,870

(22) Filed: Aug. 27, 2003

(65) Prior Publication Data

US 2005/0046565 A1 Mar. 3, 2005

(51) Int. Cl.
*G08B 21/00* (2006.01)

(52) U.S. Cl. ..... 340/652; 340/628; 340/656; 340/693.6

(58) Field of Classification Search ..... 340/639.5, 340/652, 825, 577–9, 628–30, 539.1, 539.27, 340/539.22, 539.26, 825.19, 310.08, 310.06, 340/638, 656, 693.6; 454/229, 342, 357
See application file for complete search history.

(56) References Cited

U.S. PATENT DOCUMENTS 3,786,739 A 1/1974 Wright
3,884,133 A 5/1975 Miller
4,058,253 A 11/1977 Munk et al.
4,380,759 A * 4/1983 Sulkoski et al. ..... 340/407.1
4,570,155 A 2/1986 Skarman et al.
4,765,231 A 8/1988 Aniello
4,911,065 A 3/1990 Van Becelaere
4,944,216 A * 7/1990 McCutchen ..... 454/342
4,985,695 A * 1/1991 Wilkinson et al. ..... 340/568.3
5,067,394 A 11/1991 Cavallero
5,198,806 A * 3/1993 Lord ..... 713/200
D360,156 S 7/1995 Fenne
5,493,820 A 2/1996 Joseph
5,587,705 A 12/1996 Morris
5,691,703 A * 11/1997 Roby et al. ..... 340/628
5,729,197 A * 3/1998 Cash ..... 340/539.3
5,786,767 A 7/1998 Severino
5,855,510 A * 1/1999 McKenzie ..... 454/342
5,867,105 A 2/1999 Hajel
5,992,532 A * 11/1999 Ramsey et al. ..... 169/46
6,049,143 A 4/2000 Simpson
6,102,793 A * 8/2000 Hansen ..... 454/342
6,127,748 A 10/2000 Girard et al.
6,294,889 B1 9/2001 Briant et al.
6,356,425 B1 * 3/2002 Jung ..... 361/93.8
6,378,574 B1 4/2002 Tsutsui
6,380,852 B1 * 4/2002 Hartman et al. ..... 340/521
6,384,724 B1 5/2002 Landais
6,384,728 B1 5/2002 Kanor et al.
6,449,715 B1 9/2002 Krivoshein
6,552,647 B1 * 4/2003 Thiessen et al. ..... 340/3.1
6,552,911 B1 4/2003 Haupt et al.
6,583,720 B1 * 6/2003 Quigley ..... 340/521

(Continued)

*Primary Examiner*—Daniel Wu
*Assistant Examiner*—Travis Hunnings
(74) *Attorney, Agent, or Firm*—Dwyane L. Mason; Tara M. Williams

(57) ABSTRACT

An alarm device interface system comprising a power strip interface, a communication system, and a response system. The power strip interface comprises an electrical connection for powering and/or receiving a component in the system. The communication system comprises or utilizes sensors to detect a condition and may signal the response system to respond to the condition. Selective sending of the signal can be direct from the sensors, via transfer through a control module, or manually activated. The response system receives the selectively sent signal and may utilize one or more response components to perform a variety of functions.

28 Claims, 11 Drawing Sheets

U.S. PATENT DOCUMENTS 6,589,073 B1 7/2003 Lee
6,593,528 B1 7/2003 Franklin-Lees et al.
6,615,927 B1 * 9/2003 Kim ..... 169/37
6,769,250 B1 * 8/2004 Fuss et al. ..... 60/403
6,774,802 B1 * 8/2004 Bachinski et al. ..... 340/632
6,776,708 B1 * 8/2004 Daoutis et al. ..... 454/229

* cited by examiner

ALARM DEVICE INTERFACE SYSTEM

CROSS-REFERENCE TO RELATED APPLICATIONS

Not Applicable.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates to an element detection and response system.

2. Description of the Related Art

Several systems, which respond to negative elements such as fire and smoke, have been used in the past. In U.S. Pat. No. 4,765,231 issued to Aniello, a system is disclosed in which an evacuation system for a building is integrated into the existing air conditioning ducts. The air conditioning fan is reversed upon detection of fire or smoke, causing the smoke to be drawn up through the ductwork and out of the building.

In U.S. Pat. No. 3,884,133, issued to Miller, a system is disclosed, which uses a divided common return air duct that on one side of the divide returns air from a fire zone and on the other side of the divide, returns air from non-fire zones.

In U.S. Pat. No. 4,058,253, issued to Munk et al., a system is disclosed which utilizes dampers to control the air cycling in a building air conditioning system. Upon the detection of smoke, the dampers are adjusted and the smoke is prevented from recirculation—ultimately, evacuating the smoke out of the building.

In U.S. Pat. No. 3,786,739 issued to Wright, a system is disclosed, which utilizes a venting system for removing smoke and fumes from kitchen areas. A conduit has liquid spray nozzles for extracting smoke and fumes from an air stream as well as a suction fan for drawing air through the conduit.

In U.S. Pat. No. 5,493,820, issued to Joseph, a system is disclosed which utilizes a duct system containing a water filled conduit for aiding in the extinguishing of fires. Temperatures reaching an elevated level cause a valve in the conduit to open, allowing cold water to flow through the conduit and force water onto the roof of the building.

SUMMARY OF THE INVENTION

In one embodiment, the system according to the present invention comprises a power strip interface, a communication system, and a response system, arranged and designed to alert, evaluate, or if necessary respond to a condition. In one embodiment, the power strip interface comprises an electrical connection for powering and/or receiving a component in the system. The power strip interface also allows for quick removal and interchangeability of system components so that it may be customized quickly as required. In one embodiment, the communication system comprises sensors to detect elements in the structure and sends signals to the response system to respond to the elements. Selective sending of the signal via the communication system may be accomplished in a manner known to those skilled in the art, e.g., via physical connections or wirelessly. In a first embodiment, the sensors affect the selective sending of the signal to the response system. In a second embodiment, the sensors provide information to a control module, which affects the selective sending of the signal. In a third embodiment, the selective sending of the signal is manually activated. In a fourth embodiment, a control module sends and receives information over an AS-I compliant communication bus. The system according to the present invention may also be a portable, a fixed-in-place type, or a combination system. The components in the system may also be portable, fixed-in-place, combined with other components, or a combination thereof.

In one embodiment, the response system receives the selectively sent signal and utilizes response components to perform a variety of functions. In a first embodiment, the response component includes a spray passage to communicate pressurized fluid into the structure. In a second embodiment, the response component includes a vacuum generator to purge the structure of potentially harmful elements. In a third embodiment, the response system, includes alert devices, which stimulate senses or are otherwise detectable. In a fourth embodiment, the response system includes a combination of response components that respond to multiple situations.

BRIEF DESCRIPTION OF THE SEVERAL VIEWS OF THE DRAWINGS

A better understanding of the present invention can be obtained when the following detailed description of the disclosed embodiments is considered in conjunction with the following drawings, in which.

DETAILED DESCRIPTION OF THE INVENTION

Figure 1:
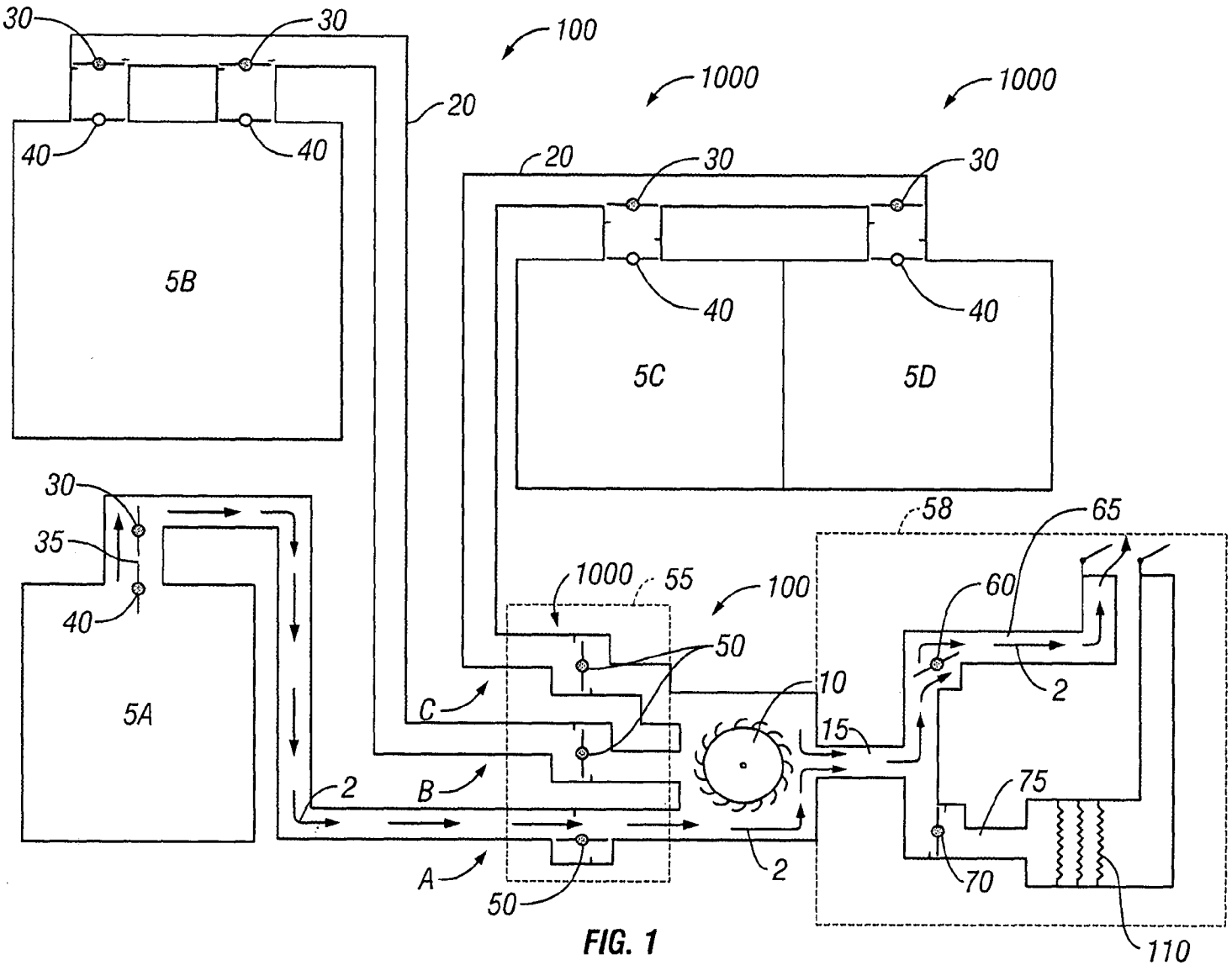
FIG. 1, in an elevated cut-out view, shows an embodiment of the response system utilizing valves and a conduit system to purge the structure of undesired elements.

The preferred embodiment of the present invention utilizes a communication system to detect undesired elements within a structure. This communication system can include sensors that can detect one or more of a variety of elements including smoke, carbon dioxide, thermal energy, airborne particles, and the like. The sensors can be utilized to determine if and when the communication system should send a signal to a response system, allowing an appropriate response depending on the signal received and the element present.

In a simpler embodiment, the communication system can include a direct communication link (hard-wired or wireless) between the sensor and response component. In such an embodiment, the sensor detects levels of at least one element. When a set point level is detected, a signal is transmitted to the response system to respond accordingly.

In a more complex embodiment, the communication system can utilize a control module which receives information from a sensor and based upon a preset parameter determines whether or not to send a signal to the response system to respond. The control module, in one configuration can exist outside of the structure via a communication network. Additionally, the control module can be programmable, e.g., a distributed control system ("DCS") or programmable logic controller ("PLC") to selectively send and receive signals for monitoring parameters and initiating responses. In such an embodiment, the communication system can utilize industry standard hard wired buses or industry wireless for transmitting signals, data, or other information.

In another embodiment, the communication system can include an initiation device, for manual operation which bypasses the communication systems (if they are being utilized) to activate the appropriate response system. It will be understood by those skilled in the art that these communicative embodiments can be combined in a common system.

In the preferred embodiment of the response system, a response signal from the communication system can cause a response component to be activated to respond to a condition. In one embodiment, the response system can include a conduit system, which when utilized in conjunction with a vacuum generator purges the interior of the structure of elements. This embodiment can utilize valves to create channels to a specific zone, efficiently focusing vacuum power on the desired zone In another embodiment, the response system can include alert devices, which stimulate human senses such as sight, sound, and touch or activates or energizes a warning mechanism such as a person, seeing eye dog, robot, or other monitoring system or warning device. In one configuration of this embodiment, the alert device can be a wireless portable unit, which can be carried around by an individual. In another configuration of this embodiment, the alert device can be a power bar providing electricity in a standard mode, whereupon receiving a signal from the communication system activates to alert the aforementioned human senses.

In another embodiment, the response component includes a spray passage, which is arranged and designed to communicate pressurized fluid into an interior of the structure. The three abovementioned embodiments can either be used alone or in combination.

Air Conduit System

FIG. 1 is an embodiment of the response system 100 utilizing a conduit system 20 in conjunction with a high powered vacuum 10, and one or more response components 1000 to purge the structure of undesired elements (hereinafter, collectively referred to as the HPU©). The response components 1000 in this embodiment can include valve 30, 40, 50. In FIG. 1 the structure is a house, building, or apartment unit with rooms, generally indicated by zones 5A, 5B, 5C, and 5D. While the embodiment of FIG. 1 has been shown with reference to a house, building, or apartment, these structures are shown and described for explanatory purposes only and do not preclude the use of this embodiment in other structures, which should become apparent to one of ordinary skill in the art. When the entire response system 100 of this embodiment is in a purge mode, the four zones 5A, 5B, 5C, and 5D are in communication with an air manifold 55 via the conduit system 20. Preferably the conduit system 20 is internally lined with an element resistant material (e.g., flame resistance, corrosion resistance, etc), enabling the conduit system to be maintained for extended periods of time. However, in other embodiments, the conduit system 20 need not have an internal lining. Each of the respective zones 5A, 5B, 5C, and 5D can maintain independent communication with the high powered vacuum 10 via a passive valve 40 and solenoid valve 30, the details of which are described with reference to FIG. 2.

The embodiment of the response system 100 shown in FIG. 1 can include a vacuum generator, such as the high powered vacuum 10. This high powered vacuum 10 on one side can couple to the conduit system 20 via an air manifold 55 and on the other side can couple to an exhaust valve 60 or 70. Upon receiving a signal from the communication system, the high powered vacuum 10 is activated, establishing a vacuum or negative air flow on the side of the air manifold 55 and a high pressure on the side of the exhaust valve 60, 70. The differential pressure created by high powered vacuum 10 can serve as the force which can purge the entire building, upon establishment of communication channels. This channeling, as will be described below, focuses the force of the high powered vacuum 10 upon the desired zone or zones 5A, 5B, 5C, 5D or a combination thereof. While in this embodiment only one high powered vacuum 10 is shown, other embodiments may include one or more high powered vacuums 10. Additionally, other embodiments can include devices other than a high powered vacuum—for example, fans or the like—which can help establish the above-described negative air flow.

The channeling of the negative air flow from each respective zone 5A, 5B, 5C, and 5D through air conduit system 20 can be facilitated via the air manifold valves 50, solenoid valve 30 and active valve 40. The air manifold valves 50 can serve as an initial negative air flow channeling device, establishing communication to different paths in the conduit system 20, generally indicated by letters A, B, and C. Each path A, B, or C, in turn, can establish communication with a particular zone via solenoid valve or valves 30 and active valve or valves 40 (described in more detail with reference to FIGS. 2A, 2B, and 3). While this channeling system has been described with reference to four zones (5A, 5B, 5C, and 5*d*) and three paths (A, B, C) in the conduit system, such a description is intended to be only explanatory thereof. For example, there can be only one path or a there can be a plurality of paths, accommodating only one air manifold 55 or a plurality of air manifolds 55 to channel to one zone or a plurality of zones and even subzones. The selection of these features in some embodiments can depend on the specificities of a particular building—for example, size of the building, number of rooms, size of the rooms, etc.

The conduit system 20 as described in this embodiment of response system 100 preferably is not the same conduit as that which would be used for other systems (e.g., an air conditioning system). This separate system capability allows the response system 100 to be reused, over and over again—not contaminating the other conduit systems. In other embodiments, the conduit system 20 may share a conduit with other systems.

Exhaust System

Once an element is drawn into the high powered vacuum 10, the element can be purged through an exhaust system 58. The configuration of exhaust system 58 in FIG. 1 includes two channels (via path 65 and path 75), a passage 15, and valves 60 and 70, corresponding to paths 65 and 75. In other embodiments, the exhaust system 58 can include other component parts. In the embodiment of FIG. 1, the elements initially travel through passage 15, whereupon they can be channeled through either path 65 or path 75. The channeling of the high pressure through these paths 65 and 75 is dependent upon the type of element being purged from the building. The control of this channeling occurs via the exhaust valve 60 or the filter exhaust valve 70. Upon receiving a signal from the communication system 200 (not shown), each exhaust valve 60 and 70, can be activated.

Some elements can be purged through the normal exhaust valve 60 while others (e.g., toxic or chemical agents) can be exhausted through the filter exhaust valve 70. Elements exhausted through the normal exhaust valve 60 and path 65 can be directly released into the ambient air. Elements exhausted through filter exhaust valve 70 and path 75 can be embedded in a filtering chamber 110 (e.g., a HEPA filter) thereby allowing element reduced or free air to be released to the atmosphere. For example, in some embodiments, the element may be of such a nature that the element is never released to the atmosphere, but rather captured in a contained unit (not shown). Further, it is to be expressly understood that other embodiments can utilize different component parts—some of which may be controlled by the dynamics of the system. For example, some embodiment will not require multiple exhaust routes and some embodiments may require more than one exhaust route.

As an illustrative example, FIG. 1 shows the exhaust route, indicated by arrows 2, of elements from zone 5A. The high power vacuum 10 has been activated after receiving a signal from the communication system 200 (not shown). Zone 5A is in direct communication with the high powered vacuum 10. Such communication is established, initially via opening of air manifold valve 50, allowing negative air flow from path A of the conduit system 20. In turn, communication between Zone 5A and path A of the conduit system 20 is established via opening of solenoid valve 30 and passive valve 40, allowing passage from Zone 5A through passage 35 to path A of the conduit system 20. With establishment of this communication, an undesired element, such as air, smoke, gas, humidity, or the like can be purged from zone 5A to the high powered vacuum 10. Once the undesired element reaches the high powered vacuum 10, the element is pushed through to the exhaust system 58, whereupon after travel through passage 15, valves 60 and 70 control the exhaust route through path 65 or path 75.

Continuing with the illustrative example, FIG. 1 shows zones 5B, 5C, and 5D as inactive or not in communication with the high power vacuum. The solenoid valve 30 and passive valve 40 of each respective zone 5B, 5C, and 5D, are closed sealing a passage 35 between the zones 5B, 5C, and 5D and the conduit system 20. Additionally, valves 50 for paths B and C of conduit system 20 are closed, disconnecting paths B and C from communication with the high powered vacuum 10. As described above, such channeling allows the force of the high powered vacuum 10 to be focused on the zone of interest (shown in FIG. 1 as zone 5A)—thus, increasing efficiency of the system. With the description of channeling, it is to be expressly understood that some embodiments of the invention do not utilize channeling.

Figure 2A:
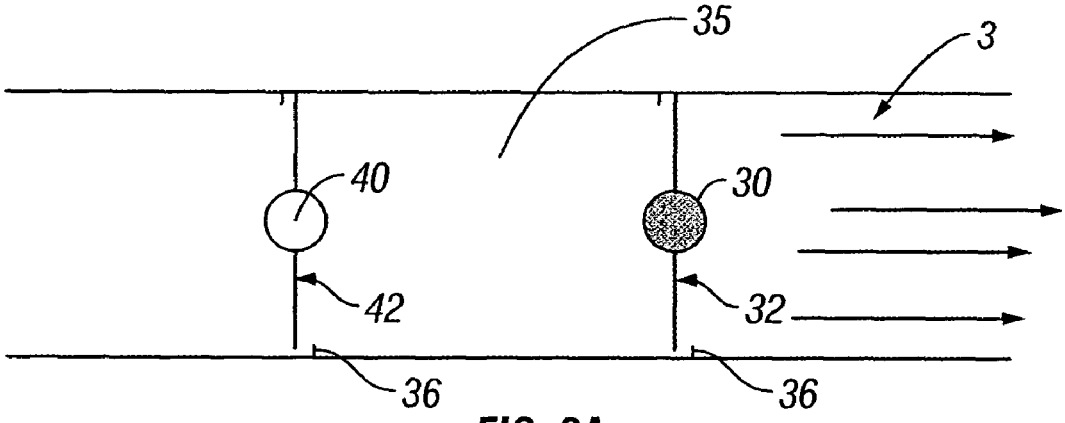
FIGS. 2A and 2B are a cut-out elevation view showing the details of a passive and active valve from the embodiment of FIG. 1.
Figure 2B:
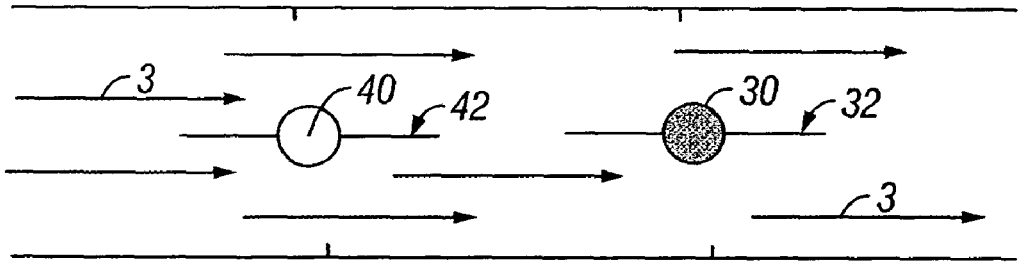

FIGS. 2A and 2B are a cut-out elevation view showing the details of one configuration for the passive and active valves, 40 and 30, described with reference to the embodiment of the response system 100 of FIG. 1. In a closed state, as seen in FIG. 2A, the valve flaps 42 and 32 seal passage 35 prevent negative air flow through passage 35, which is part of the conduit system 20. The passive valve 40 is preferably a free flowing, spring-loaded device with a valve stop 36 which brings the flap back into the normal position. In this embodiment, the flaps 42 are urged counter-clockwise by the spring (not shown). The active valve 30 is activated and deactivated—rotatably opened and closed—when a signal is sent from the communication system 200.

As an illustration of the operation of the passive valve 40 and active valve 30 and with reference to FIGS. 2A and 2B, a force of negative air, indicated by arrows 3 (a suction force, described with reference to FIG. 1) initially exists on the active valve 30. This force of negative air as illustrated in FIG. 1 can be created via high power vacuum 10 (or in other embodiments via a fan or the like), opening select valves to establish a communication channel. To complete the communication channel, the active valve 30 is rotatably opened (as shown in FIG 2B), allowing the negative air flow through the passage 35. The negative air flow, upon traveling through passage 35, rotatably opens the passive valve 40 by overcoming the counter-clockwise urging force of the spring or detent mechanism (not shown). The urging force of this spring or detent mechanism exists to allow the passive valve 40 to move freely, opening when suction occurs in a given zone, and closing/sealing the area or zone from the back flow of negative elements, such as fumes, smoke, gases or the like.

Figure 3:
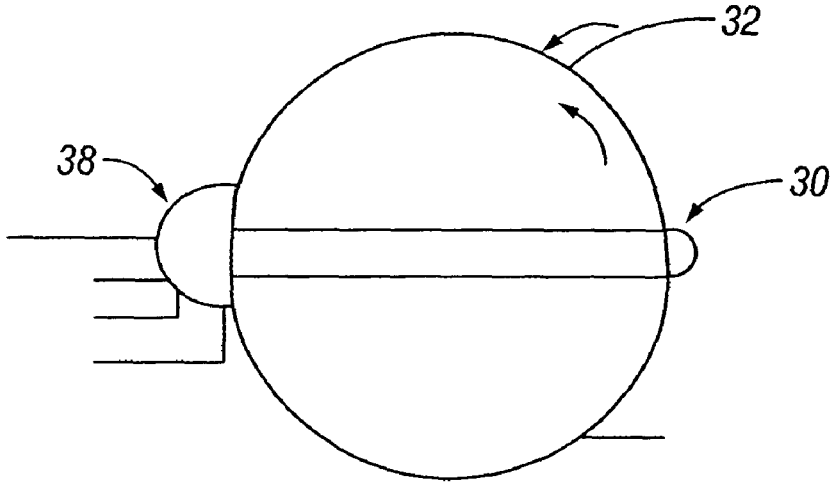
FIG. 3 is a cross section cut across lines 3—3 of FIG. 2B, showing the details of the operation of the active valve from the embodiment of FIG. 1.

FIG. 3, in a cross-section cut across lines 3—3 of FIG. 2A shows the details of the operation of the active valve 30. The active valve 30 is inside the conduit system 20 and utilizes a solenoid motor 38, which maintains a latch opened or a latch closed state. Upon receiving a signal from the communication system 200, the solenoid motor 38 will latch open and stay in a latch opened state. This feature can serve as a safety device, allowing the latch to remain open even if the fire and smoke are intense. Upon receiving another signal from the communication system 200, the solenoid motor 38 will latch close, remaining in the latch closed state. In addition to the latched open and latched closed position, the active valve 30 can include a sensor feedback, which as will be described below with reference to FIGS. 10A and 10B, can be utilized for diagnostic testing of the active valve 30.

Figure 4:
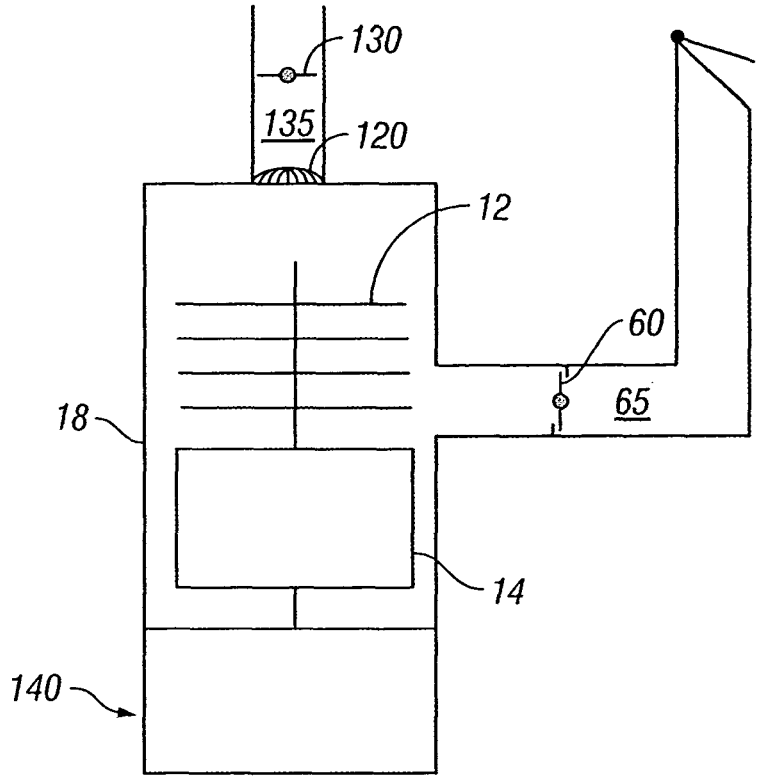
FIG. 4, in an elevated cut-out view, shows the details of a configuration for the high power vacuum in the embodiment of the response system of FIG. 1.

FIG. 4 shows an elevated cut-out view of the details of a configuration for the high power vacuum 10 in the embodiment of the response system 100 of FIG. 1. In the configuration of FIG. 4, the high-powered vacuum 10 includes a plurality of blades 12 and a motor 14. The motor 14 can be a powerful high torque, high revolution-per-minute motor with a single to three phase cycle. The plurality of blades 12 can be a multi-fan blade design similar to that of a jet engine. While motor 14 and plurality of blades 12, preferably create a powerful negative air flow force, the level of force is dependent on the dynamics of the system—for example, the number of zones, size, etc. Other similar configurations should become apparent those of ordinary skill in the art.

In the configuration of FIG. 4, an inlet valve 130 establishes communication between the high-powered vacuum 10 and conduit system 20 via passage 135. The inlet valve 130 is an active hamper that opens and closes the suction or negative air flow of the system. A mesh screen 120 covers the end of passage 135 at the opening to high-powered vacuum housing 18. The mesh screen 120 catches any debris that would come through the conduit and possibly cause damage to the plurality of blades. In some configurations, a suction or pressure sensor (not shown) can be utilized to engage or disengage the inlet valve 130—even if the high power vacuum is clogged. An outlet valve 65 similar to that described in FIG. 1 controls the exhaust from the high-powered vacuum 10 through passage 65 to the atmosphere. As described with reference to FIG. 1, other configurations and embodiments of this system can include more than one exhaust valve. The motor 14, while being powered via commercial power supply, can be powered by a back-up system 140, described in FIG. 5.

Figure 5:
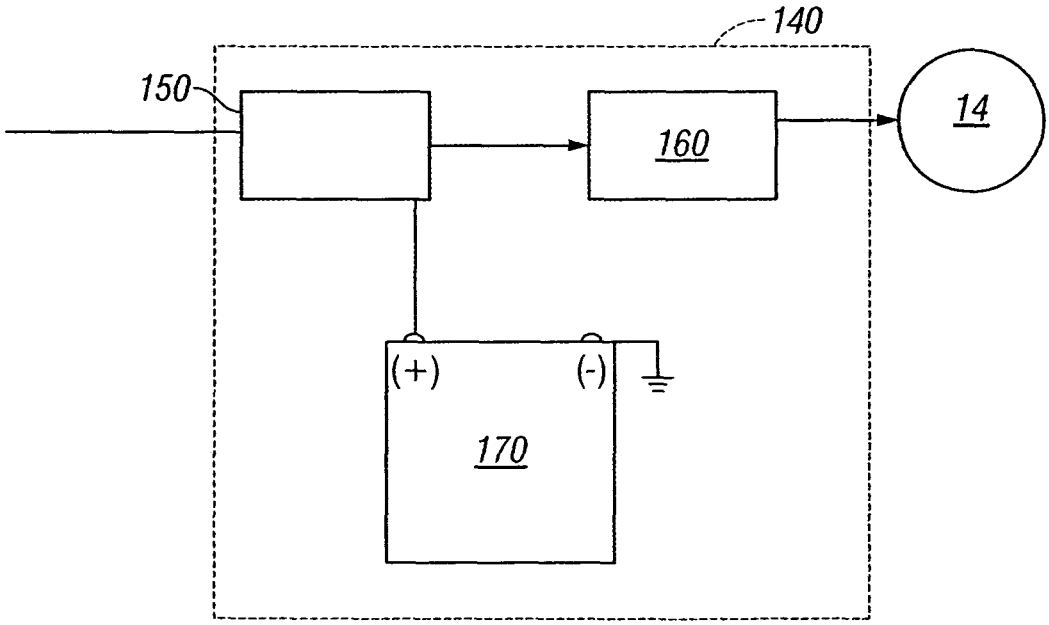
FIG. 5 is schematic of a configuration of the backup system from FIG. 4.

FIG. 5 is schematic of a configuration of the backup system 140 referenced in FIG. 4. The backup system 140 can serve—in some embodiments—as the power source for the system when the commercial power supply has been interrupted. The backup system 140 includes a power sensor module 150, inverter 160 and a battery bank 170. Sensor module 150 is arranged and designed to monitor the incoming commercial power supply. When this commercial power supply is interrupted, the power sensor module 150 detects the power failure and switch over to the battery bank 170, which sits on standby. During an outage, and in the event that the system is activated, the battery power from the battery bank 170 goes through the inverter 160 and into to the motor 14. When commercial power is restored, the sensor module 150 switches back to commercial power supply and recharges the battery bank 170. In other configurations, the battery power of the battery bank 170 can be completely drained before recharging the battery. In emergency situations, the backup system 140 can provide enough power to allow inhabitants of a house, apartment or commercial building time to get out of the building. With the above description of the backup system 140, it is to be expressly understood that some embodiments do not have a backup system 140.

Hybrid System

Figure 6:
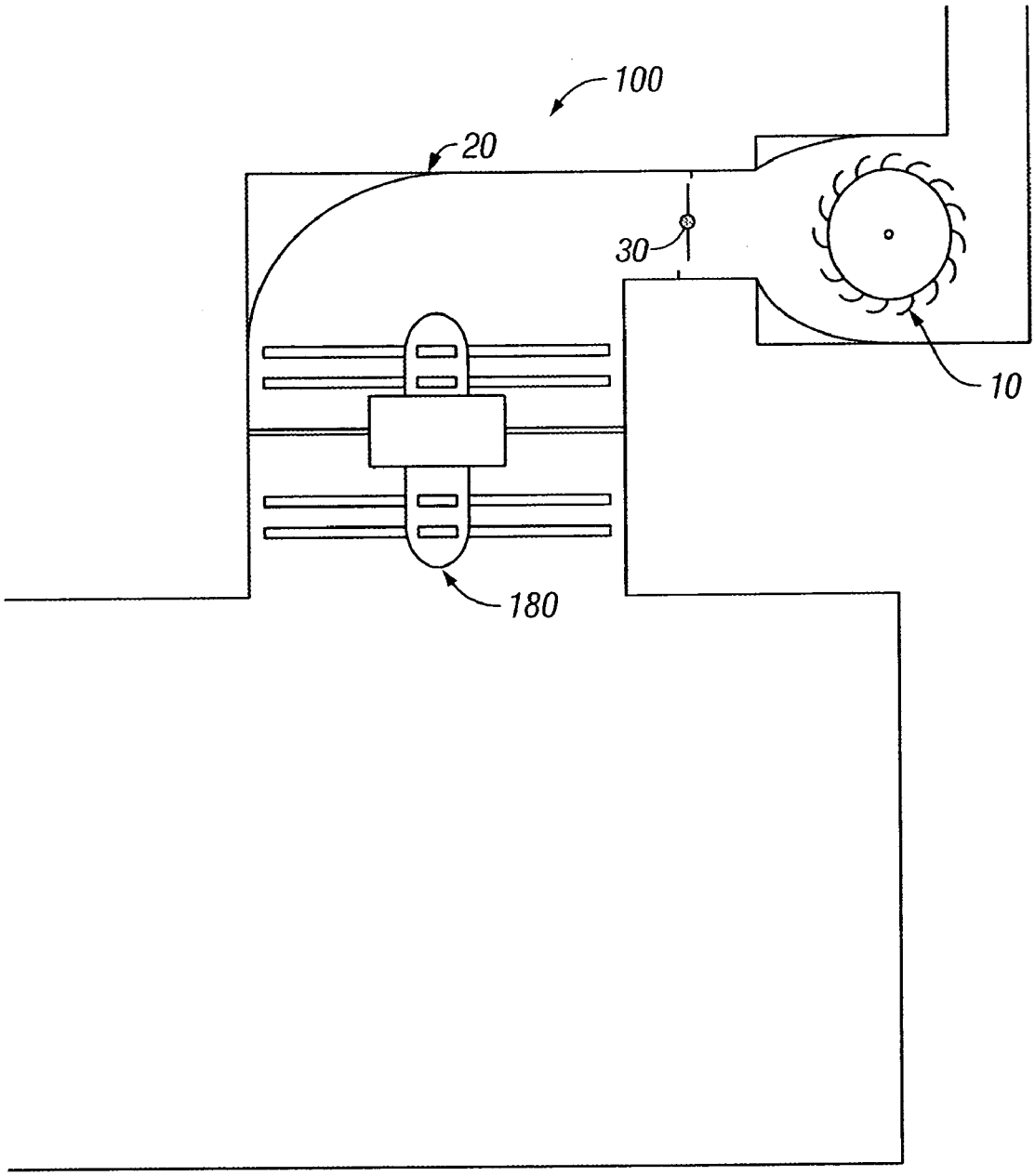
FIG. 6, in an elevated cut-out view, shows an alternative configuration of the embodiment of response system 100 from FIG. 1.

FIG. 6 shows an elevated cutout view of an alternative configuration of the embodiment of response system 100 from FIG. 1. This hybrid system is similar to that which was described in FIG. 1, except that a fan 180 is used in conjunction with the high powered vacuum 10. In the configuration of this embodiment the fan can be a double-headed fan 180, adjoined to a large square footage area. This configuration is ideal for large areas such as stadiums, arenas, cathedrals and the like. As the area in a building becomes larger, the high powered vacuum 10, by itself, can become less effective in pulling in an undesired element located at a far distance from the opening of the conduit system 20. The double-headed fan 180 can increase this efficiency by aiding the high powered vacuum in pulling in these undesired elements.

While this hybrid system has been shown with reference to purging one large area, in other embodiments, it can also be used in configurations similar to that of FIG. 1, where one of the zones may be larger than others—e.g., a gymnasium of school or a cafeteria of a retirement home. In such an embodiment, the fan can serve as a booster by gathering of negative elements and aiding the high powered vacuum 10 for that particular area. The arrangement and design of the fan can be dependent on the dynamics of the system, including size of the room and negative air flow force created by the high powered vacuum 10.

Remote Alarm Power Strip

Figure 7:
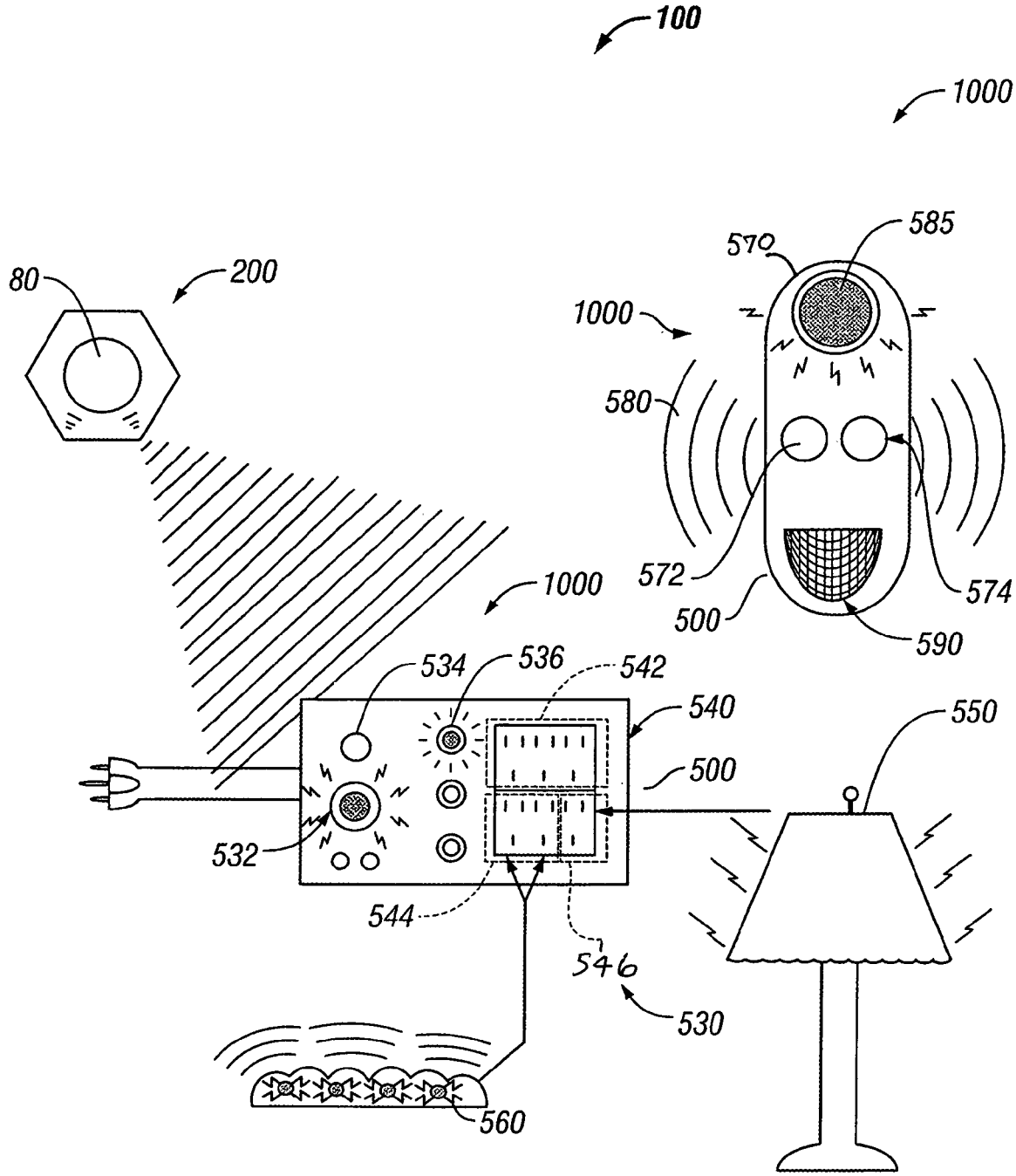
FIG. 7 shows another embodiment of the response system, which utilizes alert devices to appeal to human senses.

FIG. 7 is another embodiment of the response system 100, which utilizes the response component 1000 to appeal to the senses. The response component 1000 in this embodiment includes alert devices 500, which are arranged and designed to notify individuals of potential negative elements, regardless of whether the individual has sensory deficiencies (e.g., sight or hearing). One configuration of the alert device 500 is an all person alarm system 530. The Alarm System 530 in this embodiment comprises a mobile alarm system having an alarm power strip interface and an alarm device that can be located and relocated as desired. The mobile alarm system may be powered by means well known in the art such as a fixed power outlet, via an uninterruptible power supply (UPS), or batteries. The Alarm System 530 in this configuration includes a built in alarm buzzer 532, a reset/test button 534, indicator lamps 536(e.g., green-power, yellow-standby, red-alarm activated), and can include features such as a ground fault, a line filter, phone filter, and a spike suppression for a television. Additionally, the Alarm System 530 in this configuration is equipped with a power strip interface 540 having six plugs. In this embodiment, the six plugs shown on power strip interface 540, three can be regular outlets 542, two can be switching circuit outlets 544, and one can be a blinking or oscillating circuit outlet 546. When the Alarm System 530 is on standby, the power strip interface 540 can be utilized as a conventional power strip. The three regular outlets 542 can also be equipped with a surge protector, a power line filter, and a ground fault circuit. Other interface configurations should become apparent to one of ordinary skill in the art—such as that disclosed in U.S. Pat. No. 6,593,528, U.S. Pat. No. 6,552,911 and U.S. Pat. No. 6,589,073 all of which are incorporated herein by reference.

In a simple illustration of the operation of Alarm System 530, intended for illustrative purposes only, the sensor 80 of communication system 200 may detect an undesired element, such as smoke. Upon detection of this element above and beyond a set point level, the sensor 80 transfers a signal to activate the Alarm System 530. This signal can be sent wirelessly as shown in this configuration or through a wired system (e.g., through powerline networked technology, such as that utilized by HomePlug of San Ramon, Calif.). Furthermore, with respect to all signals, communication can be accomplished by hard wiring or wirelessly, the latter including, Infrared (1R), radio wave, laser, RF, microwave satellite, etc. Both sensing and activation may also be communicated and activated via the portable all person alarm system 570 discussed below. Upon activation, the Alarm System 530 emits a loud sound via a buzzer 532 and a light via an alarm indicator lamp 536. The two switching circuit outlets 544 are activated—which in a standby mode are not active—activate, giving power to devices connected thereto. The blinking or oscillating circuit outlet 546—which in a standby mode provides constant power—begins to provide oscillating power or power which surges on and off. To appeal to a sense of touch, one of the two switching circuit outlets 544 can accommodate a vibrating device 560 (e.g., a device which either emits a physical vibration or a sound vibration). Such a vibrating device 560 can be connected to a bed or chair, alerting an individual in emergency situations. To accommodate a sense of sight, the blinking or oscillating circuit outlet 546 can accommodate a lamp 550 as shown in this configuration, a television or any other device which may appeal to the senses. The blinking or oscillating outlet 546 causes the accommodated device to act in an eradicated manner.

Another configuration of the alert device 500 is a portable all person alarm system 570. The Alarm System 570 operates in a similar manner to the Alarm System 530, but the Alarm System 570 does not require any external devices, connected thereto, and includes additional features, such as an HPU button 572 (part of the communication system 200) and a panic button 574. The Alarm System 570 is arranged and designed to be carried around in for example, a pocket or a purse. An individual, upon detecting an undesired element can hit the HPU button 572, manually activating the embodiment of the response system 100 described with reference to FIG. 1.

Upon receiving a wireless signal from the sensor 80 of communication system 200, the Alarm System 570 activates a vibrating device (not seen, but generally indicated by vibration waves 580)—for the sense of touch, an alarm indicator 585—for the sense of sight, and a buzzer 590—for the sense of hearing. In an alternative configuration, the Alarm System 570 can include its own sensor 80, whereupon the Alarm System 570 serves as a communication system 200 and a response system 100. In other embodiments the alert device 500 can activate or energize a warning such as a person, seeing eye dog, robot, or other monitoring system, response system, or warning device.

Alternative Embodiment: Resettable Sprinkler System

Figure 8:
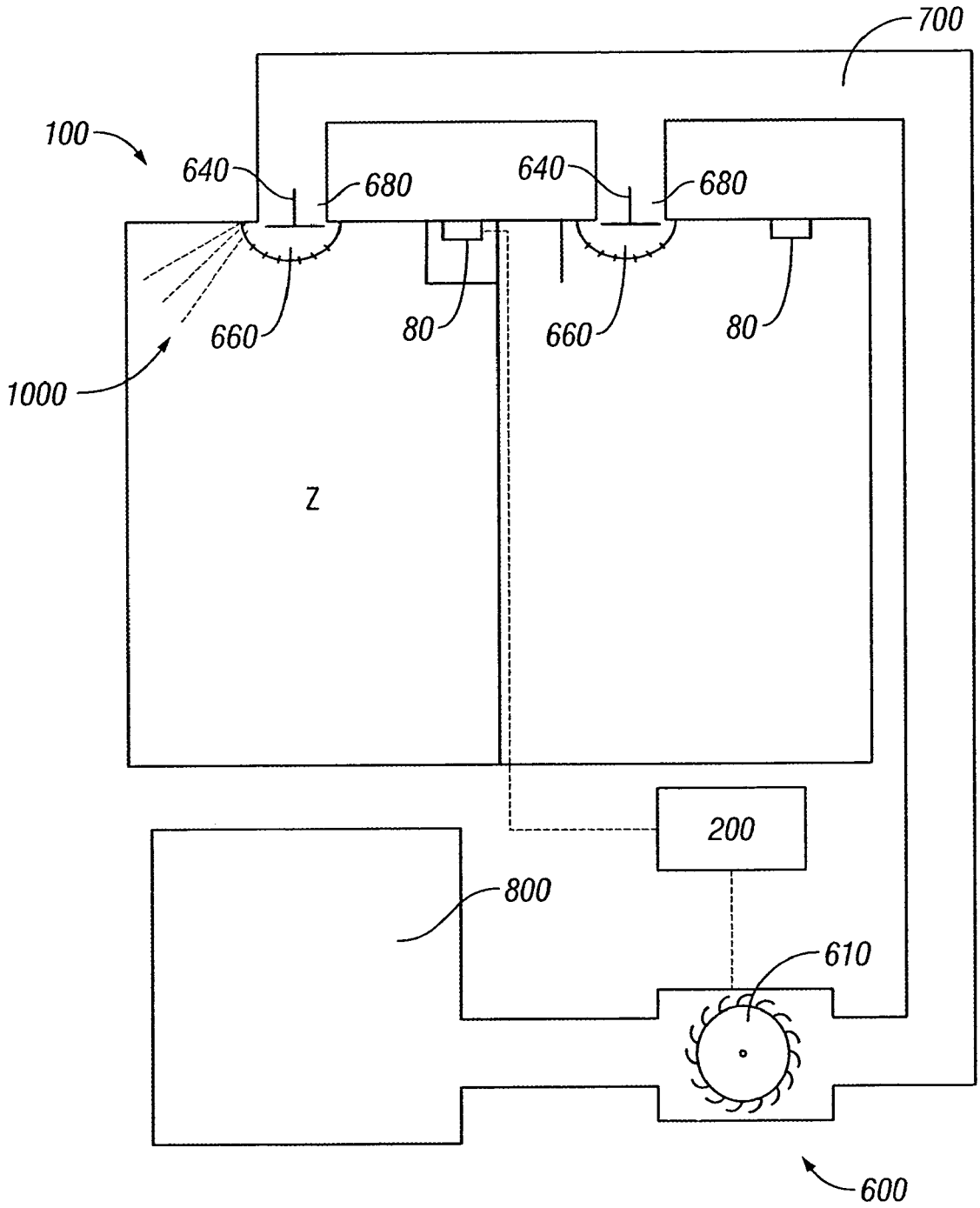
FIG. 8, in an elevated cut-out view, shows another embodiment of the response system, utilizing a sprinkler system conduit and a pressure generator.

FIG. 8 in a cut out elevated view shows another embodiment of the response system 100, utilizing a sprinkler system conduit 700 and a pressure generator 600, such as pump 610. Fluidly coupled to the sprinkler system conduit 700 is one or more response components 1000. The response component 1000 of this embodiment (better seen in FIG. 9) includes a spray passage 680, spray nodule 660, and plunger valve 640. This response component 1000 in a closed state can seal the spray passage 680 via a plunger valve 640, preventing fluid communication between the sprinkler system conduit 700 and a zone Z.

The pressure generator 600 is in fluid communication with the sprinkler system conduit 700 and is arranged and designed to maintain a constant pressure on the sprinkler system conduit 700. The pressure generator draws water from a water reservoir 800, which as will be described below may become necessary upon activation of the response system 100. The water reservoir 800 can include the pre-existing water lines of the building, a tank, or a tank connected to the pre-existing water lines of the building.

In operation, the response system 100 activates upon receiving a signal from the communication system 200. A situation which may predicate this signal is the temperature in a particular zone exceeding a set point level. The sensor 80 detects the temperature exceeding the set point level whereby the communication system 200 activates the pressure generator 600, sending water through the sprinkler system conduit 700 to the response component 1000. In a similar manner to that described with reference to FIG. 1, this water can be channeled to a particular zone via selection of which response components 1000 are activated. Upon activation of a particular response component 1000, the plunger valve 640 releases the sealing of spray passage 680, whereupon water travels through the spray passage 680 to the spray nodule 660 and out into the zone. The spray nodule 660 can be arranged and designed to spray a fine mist, instead of a heavy gush, or spray of water. This fine mist is sprayed in a semicircular pattern to cool the room more effectively and to have less of an effect on or damage to the existing units' furnishings. In other embodiments, the spray nodule 660 can spray the water in other manners. While a particular zone is being sprayed, the sensor 80 continues to monitor the temperature. When that particular zones temperature cools below another pre-determined setting (preferably below the set point level above), the sprinkler system will deactivate. In addition to the features described above, the response component 1000 of this embodiment can be programmed to have a time delay.

Figure 9:
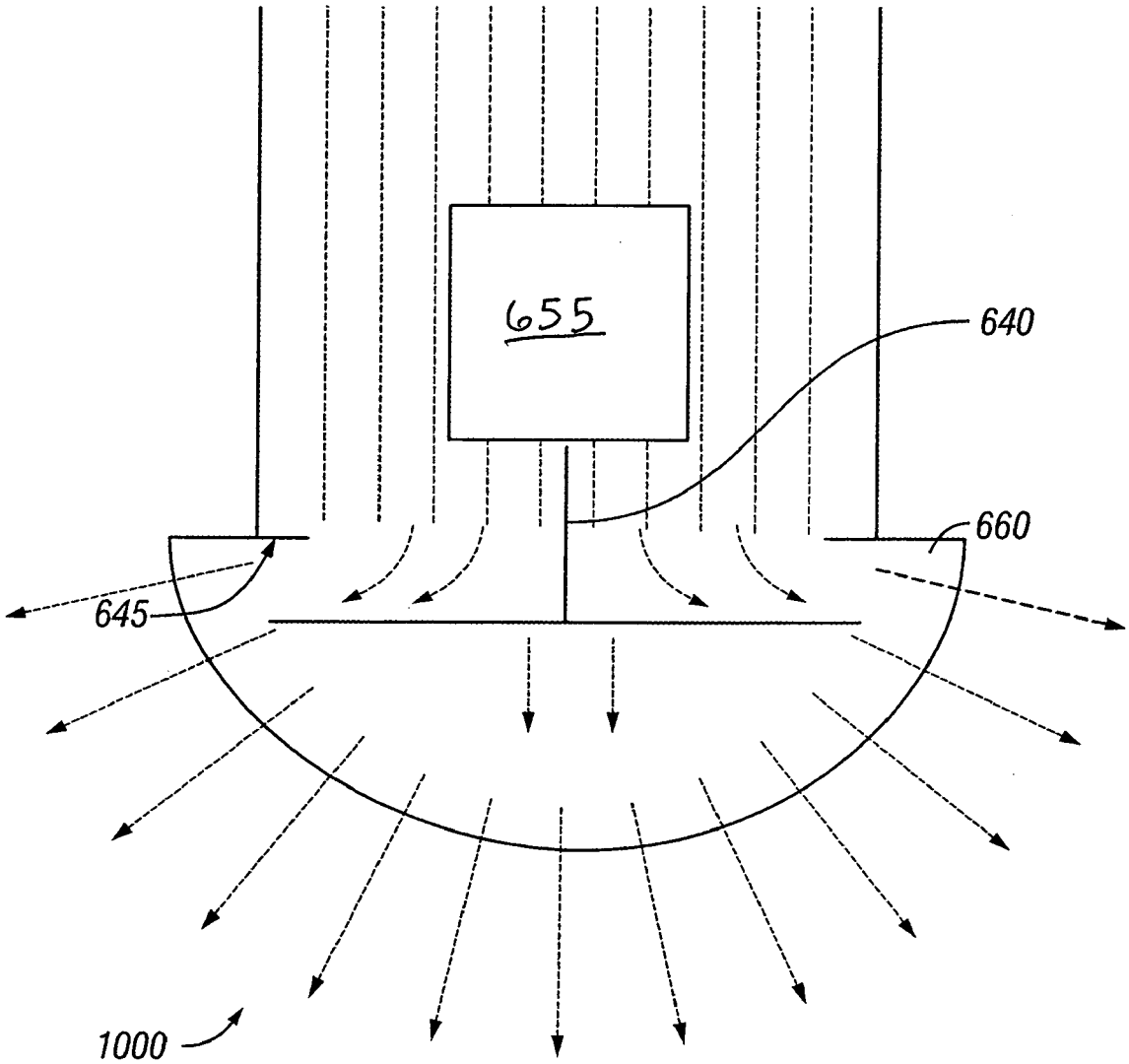
FIG. 9, in a magnified view, shows the details of the response component from FIG. 8.

FIG. 9 in a magnified view of the embodiment of FIG. 8, shows the details of response component 1000. The plunger valve 640 in a closed mode seals against a mating surface 645, preventing fluid from the sprinkler system conduit 700 from communicating with the nodule 660 via spray passage 680. The plunger valve in the open mode (as shown in FIG. 9) releases the sealing against the mating surface allowing just enough room for the pressurized fluid to move through the spray passage 680 to the nodule 660 and into the zone. The plunger valve 640 activates via a latch opened and latch closed solenoid 655. When the response component 1000 receives a signal from the communication system 200, the solenoid 655 latches open and stays in the latched open position. When another signal is received (e.g., the temperature has fallen below the pre-determined setting described above), the solenoid 655 latches closed and stays in the latched closed position. This feature allows the plunger valve 640 to remain in the open or closed position without having a constant signal.

Control Module

Figure 10A:
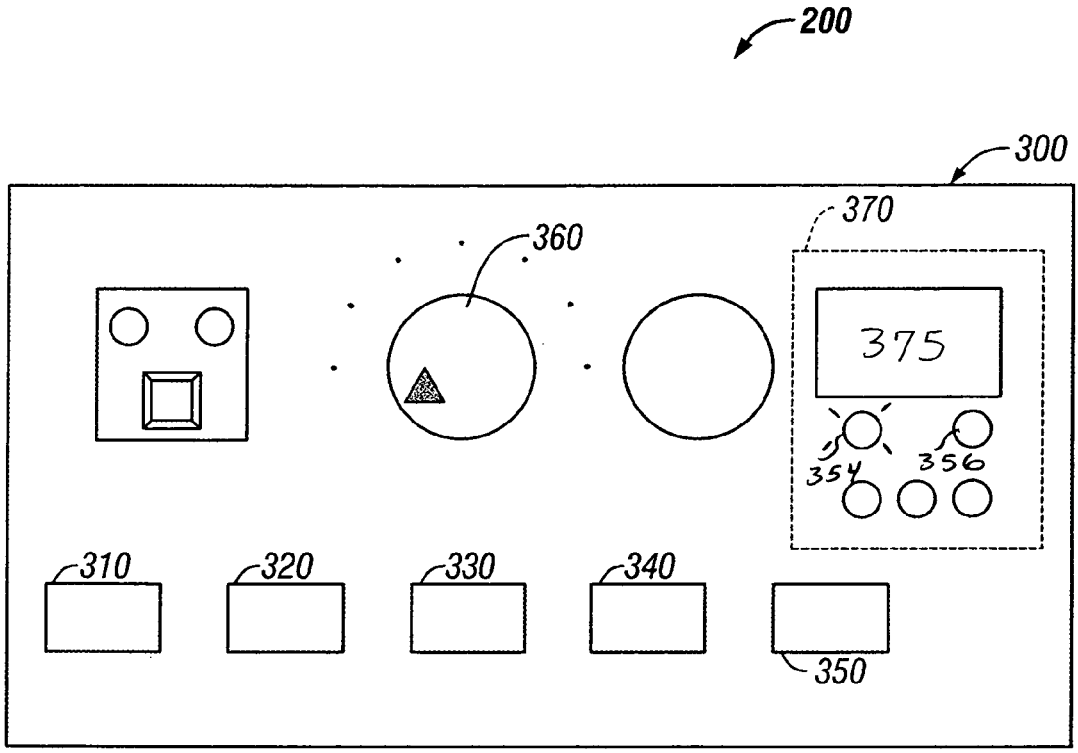
FIGS. 10A and 10B show configurations of a control module, which can be utilized in a more complex embodiment of the communication system.
Figure 10B:
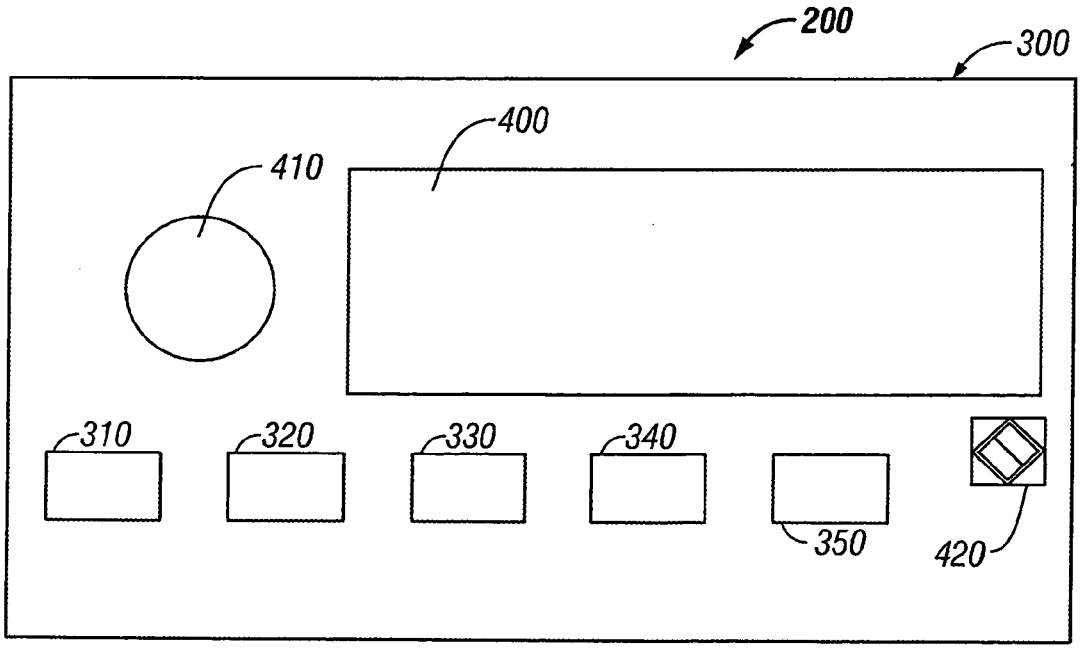

FIGS. 10A and 10B show a configuration of a control module 300, which can be utilized in a more complex embodiment of the communication system 200. According to the present invention, the control module 300, may comprise a computer, DCS, PLC, microprocessor, or any other smart or computerized control system. In such an embodiment, the control module 300 can serve as the brain of the entire system or the hub where all functions begin. In the configurations of FIG. 10A, the control module 300 can include (1) a power button 310; (2) an HPU button 320—a trigger button that turns on the HPU; (3) a reset button 330, which resets the control module 300 back to normal mode; (4) a timer button 340 that turns the unit on and off at certain intervals, (5) a by-pass switch 350; and (6) a knob 360 that controls the minimum and maximum negative air flow velocity of the high-power vacuum 10 (suction system—not seen in FIG. 10A), and a joggle switch 410, which can be utilized to help set various parameters in the control module 300. The control module 300 can set the suction of the high-power vacuum 10 from zero to ninety five percent of the capacity of the high-power vacuum 10.

The control module 300 includes an internal timer (not shown), which has several functions. The internal timer is a clock (a re-settable clock by atomic systems) that can automatically reset itself if the unit loses power. Utilizing the timer controls 370 and display screen 375, the internal timer can be set to activate the HPU on a certain zone or room at a certain specified time, turning that room into a negative airflow system. As such, the room is removed of airborne particles such as unpleasant odors, bacteria, fungus, and contaminants. The internal timer can be set for a few minutes or 24 hours. The bypass switch 350 is a hard wired system that can bypass all the circuitry of the control module 300, having a direct connection to one or more response systems 100 (e.g., the high powered vacuum 10 in FIG. 1). The bypass switch 350 is not dependent on the control module 350; and as such, the bypass switch 350 can be utilized in the event of system failure of the control module 350. The control module 300 can also include various indicator lights 354 and buttons 356, which—as should become apparent to on of ordinary skill in the art can be utilized to facilitate one or more of the many functions in which the control module 300 is arranged and designed to accomplish. For example, the indicator lights 354 can indicate when the BPU is running or when a certain timer has initiated. The button 356 can be used to override a timer being set off.

The configuration of FIG. 10B is similar to that of FIG. 10A, except that the control module 300 in FIG 10B includes an LCD screen 400, a joggle switch 410, and a menu button 420. These three devices (LCD screen 400, joggle switch 410, and menu button 420), when accessed can be utilized to set the various parameters (including timers) as well as to give statistics on a particular room—for example, temperature, atmosphere, pressure level, and the like. The control module 300 can maintain parameters on locations, time, and how much CFM (cubic feet per minute) velocity is in use. Additionally, in some configurations, the control module 300 includes a memory module (not shown) which can record and store data on various parameters of the overall system—for example, activation of alarms, pre-alarms, trouble or malfunctions of sensors, and the temperature of each zone or area. The control module 300 can be set to perform self-diagnostic procedures on the response system 100 and its corresponding components on a weekly, monthly, or an annual basis. All the recorded data will be displayed on the LCD screen and then stored in memory indicating the time and date of each malfunction. This same diagnostic procedure can be performed manually.

The control logic of the control module 300 described above in FIGS. 10A and 10B can be a microprocessor, computer, DCS, PLC, or other SMART control device. The control module 300 receives incoming information from the sensors 80 (shown in FIG. 10), processes the information, and selectively executes commands by sending signals to various response systems 100, such as high-powered vacuum 10 and valves 30,50 in FIG. 1. In the event that the system is set on a time interval, and the structure is consumed with an undesired element such as smoke or fire, the system would go into high alert mode (or full power mode), directing the response system 100 to take immediate action—e.g., directing the HPU's attention to purging the building of the undesired element. After the element has been purged, the system would go back to its original pre-set parameters. In other configurations, the timer can also regulate the re-settable sprinkler system.

The control module 300 in other configurations includes a universal remote receiver (not shown), mounted on a key chain remote. This universal remote receiver can control specific response system 100 and runs on a wireless power source such as re-chargeable batteries.

In other embodiments of the communication system, the control module 300 can lie external of the building—being operated, for example, by a computer. In such an embodiment, the sensors 80 receive information and transfer it through a network, either hard-wired or wirelessly to the externally located control module 300. In a similar manner to that described above, this externally located control module processes the information based upon preset parameters and triggers. Upon certain events being satisfied (e.g., a preset level being exceed or a timer going off), the control module 300 sends a signal back through the network to a specified response systems 100, ultimately responding in the appropriate manner.

To aid in the identification of sensors 80 and response components 1000 of several different embodiments of response systems 100, the response components 1000 and sensor 80 can include a unique identifier. This unique identifier helps identify what zone a particular sensor 80 is coming from and the location of a particular response component 1000. These unique identifiers can include a certain radio frequency or an address (e.g., and internet protocol address). In a networked environment, the identifying of information can facilitate the routing of information and signals back and forth through the communication system 200 and to the response system 100.

The various controls, displays, and buttons described with reference to the control module 300 of FIGS. 10A and 10B are intended only as providing two examples of the many embodiments, which can be utilized for the control module 300. Other configurations should become apparent to one of ordinary skill in the art.

Figure 11:
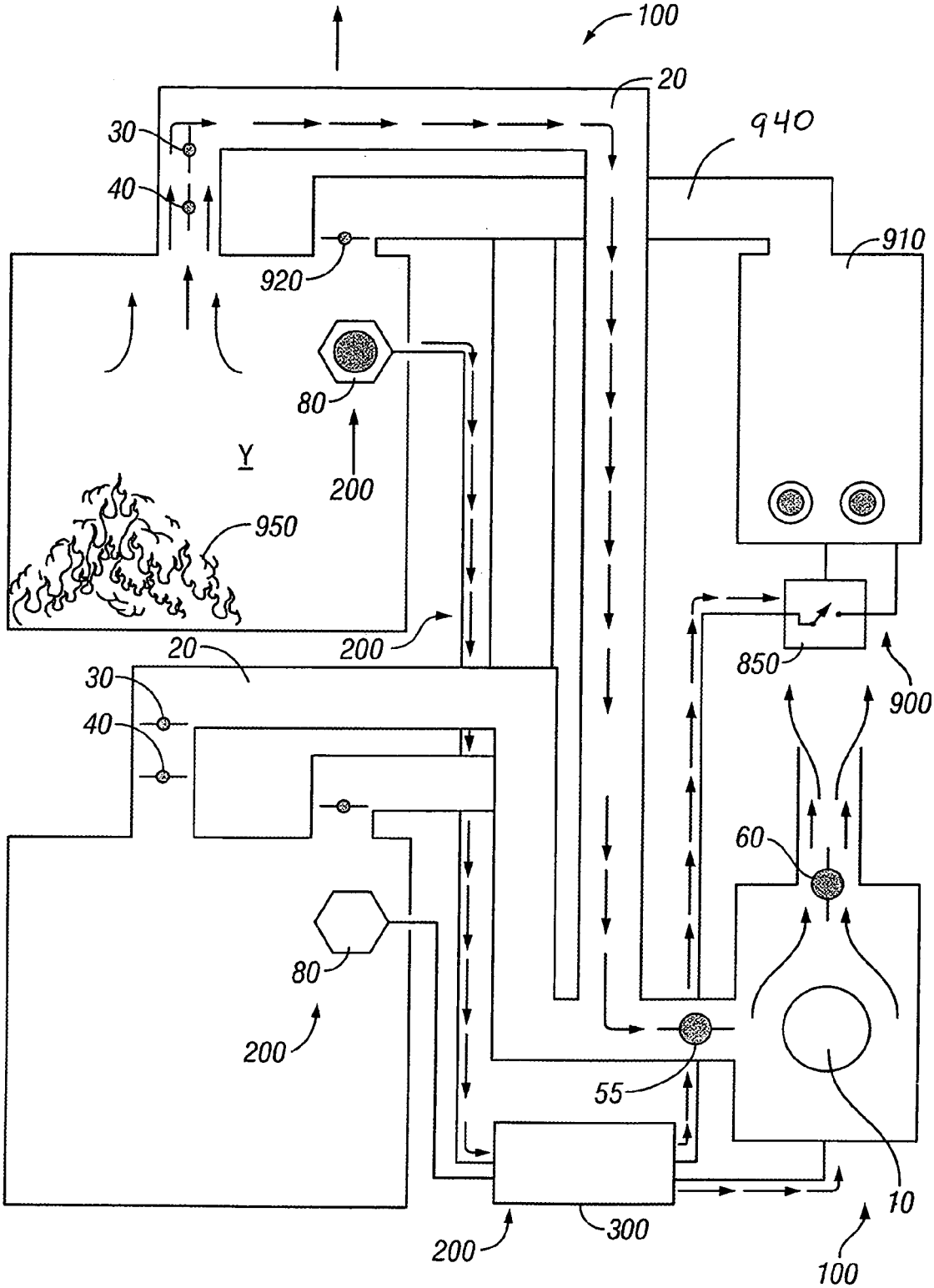
FIG. 11, in an elevated cut-out view, shows how the response system and communication system can be used with a structure device.

FIG. 11, in a cut away view shows how the response system 100 and communication system 200 can be used with a structure device 900. The structure device 900 in the example of FIG. 11 is a central unit 910 for an air-conditioning system in a building. Upon the detection of a negative element such as fire and smoke 950 in zone Y, the sensor 80 transfers information by wire or wirelessly to the control module 300. The control module 300 processes this information, identifies the location of the detectors, and then sends three signals. The first signal is sent to a latching relay 850, which shuts down the central unit 910. This latching relay 850 can be something as simple as interrupting the power supply to the central unit. Upon shutting down the central unit 910, air flow is prevented from being transmitted to all the zones, including zone Y. The shutting down of the central unit 910 prevents oxygen from being supplied to zone Y and feeding the fire. As an additional feature, a passive valve 920 can be utilized in the area where the air conditioning system connects with the zones. This passive valve 920, similar to the passive valve 40 described in FIG. 2, can be spring loaded, closing upon the air conditioning being shut off. Such closure further isolates zone Y and prevents smoke from entering the air conditioning conduit 940.

The second signal is sent to activate the high powered vacuum 10 and the third signal is sent to open active valve 30. These two components operate in the same manner as that described with reference to the first embodiment of the response system 100 as described in FIGS. 1–6, channeling the force of the negative air flow to the desired zone Y. As described earlier, the negative element travels through the air conduit system 20 through manifold valve 50 and exhaust valve 60 to the outside of the building. The high powered vacuum 10 fan will remain in operation until manually reset. This feature ensures that the fan will operate even if the smoke detector is destroyed by fire. Upon deactivation of the high powered vacuum 10, the central unit 910 will be reactivated to normal mode.

Figure 12C:
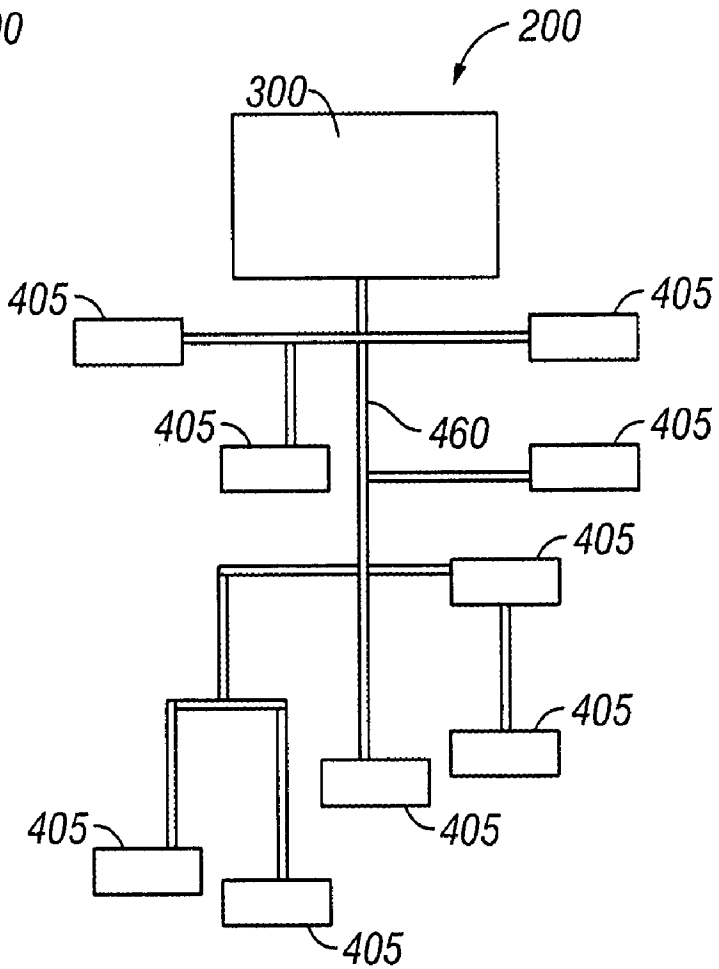
FIGS. 12A, 12B, and 12C shows in a schematic configuration another embodiment of the communication system 200.
Figure 12B:
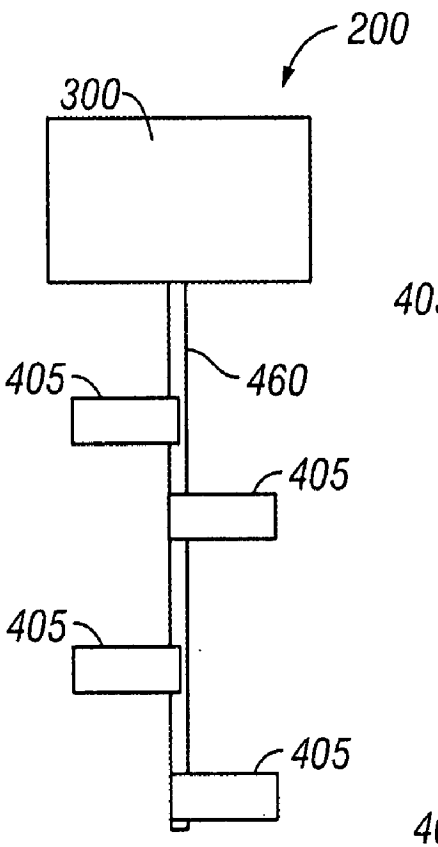
Figure 12A:
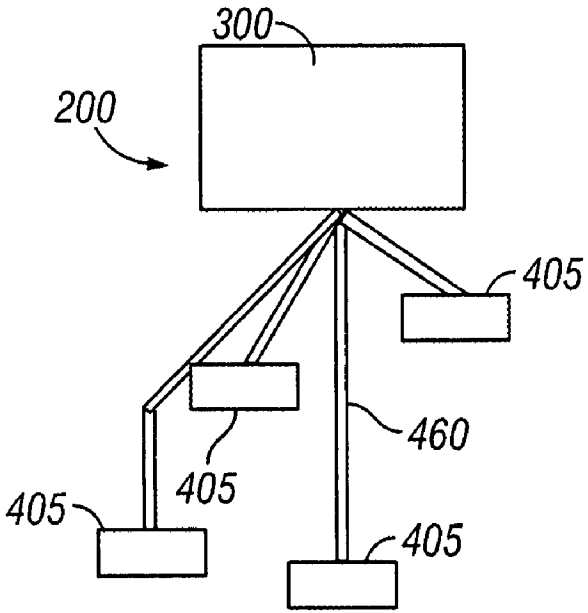

FIGS. 12A, 12B, and 12C show in a schematic configuration another embodiment of the communication system 200. In this embodiment, the communication system 200 generally adheres to the Actuator Sensor-Interface (AS-I) standard described in AS-I *Interface The Actuator-Sensor-Interface for Automation* (Werner R. Kriesel & Otto W. Madelung, 2nd ed. 1999) and on the web at http://www.as-interface.com. Additionally, the specification for the standard is described in the following patent, all of which are incorporated by reference in their entirety: U.S. Pat. No. 6,449,715 for a Process control configuration system for use with a profibus device network, U.S. Pat. No. 6,446,202 for a Process control configuration system for use with an AS-Interface device network, U.S. Pat. No. 6,294,889 for a Process and a Control Device for a Motor Output Suitable for being Controlled through a Communication Bus, U.S. Pat. No. 6,378,574 for a Rotary Type Continuous Filling Apparatus, U.S. Pat. No. 6,127,748 for an Installation for Making Electrical Connection Between an Equipment Assembly and a Command and Control System, U.S. Pat. No. 6,222,441 for a Process and Circuit for Connecting an Actuator to a Line, U.S. Pat. No. 5,978,193 for a Switchgear Unit Capable of Communication and U.S. Pat. No. 5,955,859 for an Interface Module Between a Field Bus and Electrical Equipment Controlling and Protecting an Electric Motor, all of which are incorporated herein by reference.

Control module 300 communicates with devices 405 via one or more AS-I bus(es) 460. In AS-I terminology, the control module 300 is the "master" and the devices 405 are the "slaves". Each devices 405 can either be a portion of the communication system 200—e.g., sensor 80 (described with reference to FIG. 11)—or a portion of the response system 100—e.g, a response component 1000 (e.g. valves 30, 40, 50, described with reference to FIGS. 1–3), a high powered vacuum 10 (generally described with reference to FIG. 1), or a pump 610 (describe with reference to FIG. 8).

The AS-I bus 460 includes two wires, which in accordance with the AS-I standard are capable of carrying digital data and power to the various devices. The power provided to AS-I bus 460 is such that some of the devices 405 may solely receive their power via the AS-I bus line. The power to the bus 460 and control module 300 can be powered as described with reference to other figures via a commercial power supply or a can be powered by a back-up system 140, described in FIG. 5, in the event of power failure.

The control module 300 in a manner similar to that described with reference to FIGS. 10A and 10B can be a PLC. Having preset parameters, the control modules 300 receives incoming information from the devices 405, processes the information, and selectively executes commands by sending signals to various selected devices 405.

As an illustrative example of and with reference to FIG. 11 and FIG. 12A, one of the devices 405 may be a sensor 80, which is arranged and designed to detect smoke. Upon detection of this smoke, the sensor 80 sends information through the AS-I bus 460 to the control module 300. The control module, utilizing preset parameters, processes the information and responds accordingly, possibly sending information to another device 405, such as high-powered vacuum 10 and valves 30,50.

FIGS. 12A–12C show the flexibility of the AS-I networking standard. In FIG. 12A, the network is set up in a star configuration, where each device 405 is directly connected to control module 300 via a separate AS-I bus 460. In FIG. 12B, the network is set up in a straight line configuration where each device 405 is commonly connected to control module 300 via one AS-I bus 460. In FIG. 12C, a tree configuration is shown where the devices 405 are branched off from several AS-I buses 460. In these communication systems 200, a device 405 or new line AS-I bus 460 can essentially be connected to any AS-I bus 460. For networks that have larger distances to communication between the devices 405 and the control module 300, a repeater (not shown) as is commonly know in data networking can be utilized. While the AS-I standard has generally been described with reference to this embodiment, other standards can be also be utilized in other embodiments—for example, a IEEE standard 802.3 bus. Additionally, as described with reference to other embodiments, the communication system 200 can utilize wireless networking, incorporating standards such as Wireless IEEE standard 802.11 for Wireless local area networks.

Figure 13:
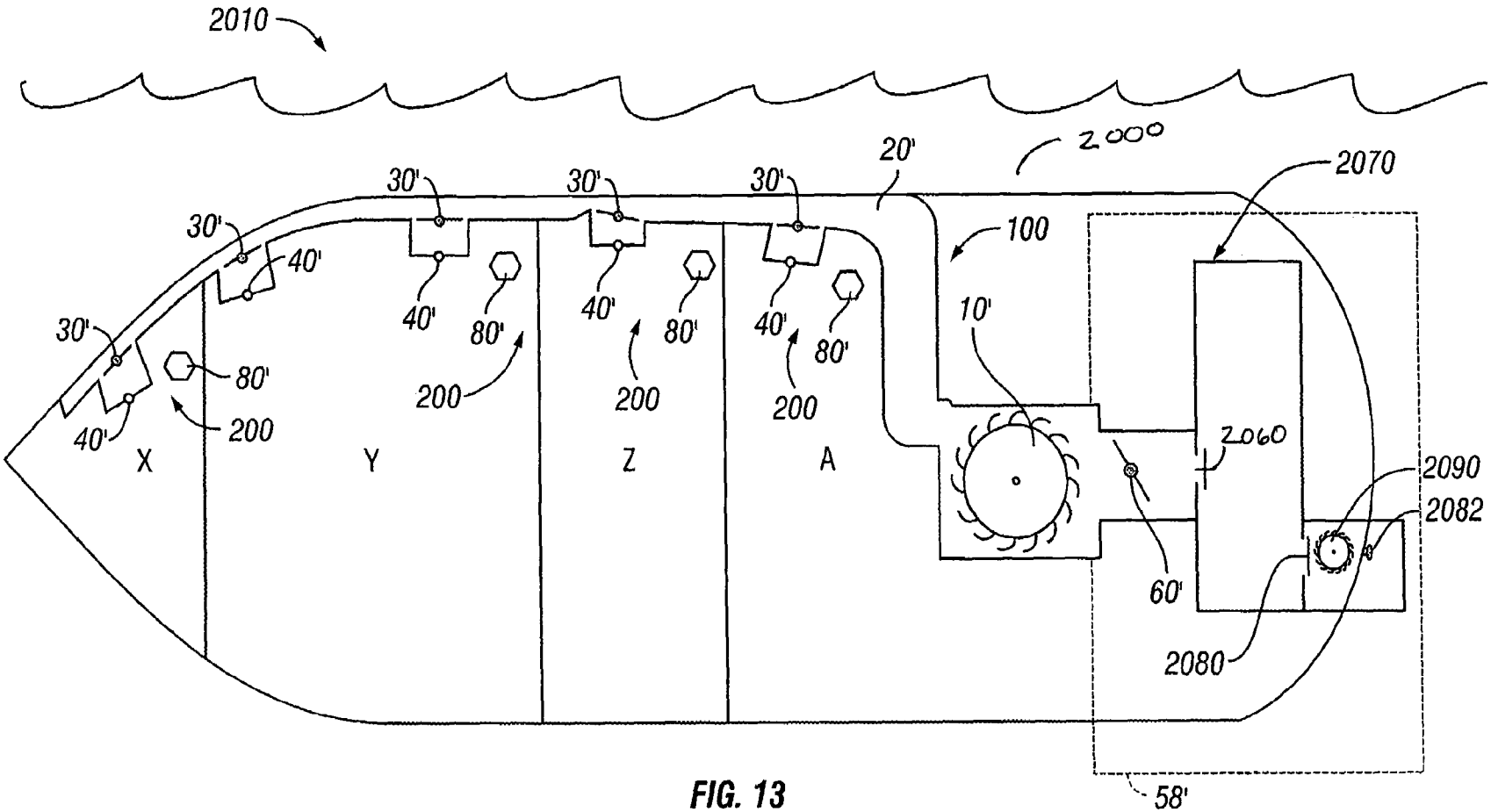
FIG. 13, in a side cut-out view, shows another embodiment of the response system and communication system in a self contained structure.

FIG. 13, in a side cut-out view, shows another embodiment of the response system and communication system being utilized in a self-contained structure. In this embodiment the structure is a submergible submarine 2000, generally shown below a sea surface 2010. Other embodiments of self contained structures should become apparent to the extent foreseeable by one of ordinary skill in the art—e.g., areas where an escape would not be permitted. In a similar manner to that described with reference to FIGS. 1 and 11, the response system 100 includes a conduit system 20', valves 30' and 40', and a high powered vacuum 10'. The communication system 200 includes sensors 80'. Upon receiving a signal from the communication system 200, the high powered vacuum 10' can be activated and the valves 30' opened to eradicate zones X, Y, Z, and A of potentially harmful substances, such as smoke through the conduit system 20' and to an exhaust system 58'.

In this embodiment, the exhaust system 58' includes an exhaust valve 60', a check valve 2060, a storage tank 2070, an exhaust check valve 2080, a pump 2090, and a check valve outlet 2082—all of which are arranged and designed to help maintain the pressure within the submergible submarine, yet allow potentially harmful substances to escape. Upon being eradicated, the potentially harmful substances are sent through the exhaust valve 60' and fed through the check valve 2060 into the storage tank 2070. The exhaust check valve 2080 is closed, allowing the storage tank 2070 to capture the potentially harmful substances. When the storage tank 2070 reaches a set point level of the potentially harmful substances, the check valve 2060 is closed. Then, an exhaust valve check valve outlet 2080 is opened and the pump 2090 is activated, forcing the potentially harmful substances through the check valve outlet 2082 into the sea. This configuration prevents water from the sea from entering the submarine 2000.

The foregoing disclosure and description of the invention are intended as being only illustrative and explanatory thereof. Various changes in the details of the illustrated apparatus and construction and method of operation may be made to the extent foreseeable without departing from the spirit of the invention.

I claim:

1. An airborne element detection and evacuation system for a structure, comprising:

a power receptacle interface that can be configured to change states;

an airborne element sensor, capable of detecting the presence of a predetermined airborne element, the airborne element sensor having an output signal indicating the presence of the predetermined airborne element;

a conduit system coupled to an interior of the structure and coupled to an exhaust apparatus, the conduit system comprising a first valve and a second valve, the first valve being interposed between the interior of the structure and the second valve, the second valve being interposed between the first valve and the exhaust apparatus; and a booster apparatus within the conduit system, the booster apparatus being interposed between the interior of the structure and the exhaust apparatus, wherein upon the output signal indicating the presence of the predetermined airborne element, a state of the power receptacle interface may be changed, the exhaust apparatus may be activated, the second valve may be activated, and the booster apparatus may be activated, whereby at least a portion of the airborne element may be removed from the structure via the conduit system.

2. The airborne element detection and evacuation system of claim 1, further comprising an alert system in communication with the airborne element detection and evacuation system, wherein the alert system comprises system alerts.

3. The airborne element detection and evacuation system of claim 2, wherein the system alerts are selected from the group consisting of visual, audible, and haptic alerts.

4. The airborne element detection and evacuation system of claim 2, wherein at least a portion of the alert system is integrated with the power receptacle interface.

5. The airborne element detection and evacuation system of claim 1, wherein the power receptacle interface includes visual and audible alerts.

6. The airborne element detection and evacuation system of claim 1, wherein the power receptacle interface is portable.

7. The airborne element detection and evacuation system of claim 1, further comprising a filter apparatus interposed between a discharge of the exhaust apparatus and an ambient atmosphere exit means, wherein prior to entering the atmosphere, the airborne element may be filtered through the filter apparatus.

8. The airborne element detection and evacuation system of claim 1, wherein the airborne element sensor is a smoke detector.

9. The airborne element detection and evacuation system of claim 8, further comprising a resettable sprinkler system in communication with the smoke detector, wherein upon detection of smoke, the sprinkler system may be activated.

10. The airborne element detection and evacuation system of claim 1, wherein the airborne element sensor is capable of detecting temperature.

11. The airborne element detection and evacuation system of claim 1, wherein the airborne element sensor is capable of detecting carbon monoxide.

12. The airborne element detection and evacuation system of claim 1, wherein the airborne element sensor is capable of detecting natural gas.

13. The airborne element detection and evacuation system of claim 1, wherein the first valve is a passive valve and upon activation of the second valve, the second valve may be opened, whereby activation of the exhaust apparatus and the opening of the second valve causes a vacuum force within the conduit system sufficient to open the first valve.

14. The airborne element detection and evacuation system of claim 1, further comprising a control system in communication with the second valve, the airborne element sensor, and the exhaust apparatus, wherein the second valve, the airborne element sensor, the exhaust apparatus, and the control system communicate via an AS-I compliant communication bus.

15. An airborne element detection and evacuation system for a structure, comprising:

a power receptacle interface that can be configured to change states;

an airborne element sensor, capable of detecting the presence of a predetermined airborne element, the airborne element sensor having an output signal indicating the presence of the predetermined airborne element;

a conduit system coupled to an interior of the structure and coupled to an exhaust apparatus;

a plurality of zones within the structure, each zone having an interior, an airborne element sensor, a first valve, and a second valve, wherein each zone's first valve is interposed between the zone's interior and the zone's second valve, each zone's second valve being interposed between the first valve and the exhaust apparatus; and a booster apparatus within the conduit system, the booster apparatus being interposed between at least one zone's interior and the exhaust apparatus, a programmable control system in communication with the airborne element sensors, the second valves, and the airborne element evacuation system, wherein upon detection of a predetermined airborne element within one of the plurality of zones, that zone's second valve may be energized to open that zone's second valve, the state of the power receptacle interface may be changed, the exhaust apparatus may be actuated, and the booster apparatus may be activated, whereby at least a portion of the airborne element may be removed from the structure via the conduit system.

16. The airborne element detection and evacuation system of claim 15, wherein opening of the zone's second valve causes the first valve of that zone to open.

17. The airborne element detection and evacuation system of claim 15, wherein opening of the zone's second valve causes the remaining zones' second valves to close sealing off the remaining zones' interiors from the conduit system.

18. The airborne element detection and evacuation system of claim 15, wherein the zone's first valve is passive and the actuation of the exhaust apparatus and the opening of the zone's second valve causes a vacuum force within the conduit system, causing the zone's first valve to open.

19. The airborne element detection and evacuation system of claim 15, wherein the plurality of second valves, the plurality of airborne element sensors, the exhaust apparatus, and the control system communicate via an AS-I compliant communication bus.

20. The airborne element detection and evacuation system of claim 15, further comprising an alert system in communication with the airborne element detection and evacuation system, the alert system comprising visual, audible, and haptic interface system alerts, wherein upon the output signal indicating the presence of the predetermined airborne element, the alert system actuates the visual, audible, and haptic interface system alerts.

21. The airborne element detection and evacuation system of claim 15, wherein the power receptacle interface includes visual and audible alerts.

22. The airborne element detection and evacuation system of claim 15, wherein the power receptacle interface is portable.

23. A method for evacuating airborne elements from a structure, comprising:

detecting, via an airborne element sensor, the presence of a predetermined airborne element within a structure;

sending a signal to an airborne element evacuation system upon the detection of the predetermined airborne element, the airborne element evacuation system comprising a conduit system coupled to an interior of the structure and coupled to an exhaust apparatus, wherein a first valve and a second valve is coupled to the conduit system, the first valve being interposed between the interior of the structure and the second valve, the second valve being interposed between the first valve and the exhaust apparatus, and a booster apparatus disposed within the conduit system, the booster apparatus being interposed between the interior of the structure and the exhaust apparatus;

changing the state of an outlet in a power receptacle interface upon the detection of the predetermined airborne element;

actuating the exhaust apparatus;

activating the booster apparatus; and activating the second valve, whereby the second valve opens allowing at least a portion of the airborne element to be removed from the structure via the conduit system.

24. The airborne element detection and evacuation system of claim 23, wherein the first valve is passive and the actuation of the exhaust apparatus and the opening of the second valve causes a vacuum force within the conduit system, causing the first valve to open.

25. The airborne element detection and evacuation system of claim 23, further comprising controlling the airborne element detection and evacuation system via a control system in communication with the second valve, the airborne element sensor, and the exhaust apparatus, wherein the second valve, the airborne element sensor, the exhaust apparatus, and the control system communicate via an AS-I compliant communication bus.

26. The airborne element detection and evacuation system of claim 23, further comprising an alerting via an alert system in communication with the airborne element detection and evacuation system, the alert system comprising visual, audible, and haptic interface system alerts, wherein upon the output signal indicating the presence of the predetermined airborne element, the alert system actuates the visual, audible, and haptic interface system alerts.

27. The airborne element detection and evacuation system of claim 23, wherein the power receptacle interface includes visual and audible alerts.

28. The airborne element detection and evacuation system of claim 23, wherein the power receptacle interface is portable.

* * * * *